United States Patent [19]

Dilgren et al.

[11] Patent Number: 4,601,336

[45] Date of Patent: Jul. 22, 1986

[54] PROCESS FOR SELECTING A STEAM FOAM FORMING SURFACTANT

[75] Inventors: Richard E. Dilgren, Houston; Kenneth B. Owens, Spring, both of Tex.

[73] Assignee: Shell Oil Company, Houston, Tex.

[21] Appl. No.: 651,388

[22] Filed: Sep. 17, 1984

[51] Int. Cl.[4] ..... E21B 43/22; G01N 15/00

[52] U.S. Cl. ..... 166/252; 73/38; 73/60.1

[58] Field of Search ..... 166/252, 250, 272, 303; 73/38, 153, 432 SD, 61.1 R, 61 R; 374/54, 25, 29–31

[56] References Cited

U.S. PATENT DOCUMENTS

| | | | |
|---|---|---|---|
| 1,827,562 | 10/1931 | Carpenter | 73/38 |
| 3,018,660 | 1/1962 | Schmid | 73/153 |
| 3,073,149 | 1/1963 | Mongan | 73/38 |
| 4,148,217 | 4/1979 | Engle | 73/38 |
| 4,458,520 | 7/1984 | Adame et al. | 166/252 |
| 4,482,634 | 11/1984 | Davis, Jr. et al. | 166/252 |
| 4,488,598 | 12/1984 | Duerksen | 166/252 |

*Primary Examiner*—Stephen J. Novosad
*Assistant Examiner*—Bruce M. Kisliuk

[57] ABSTRACT

A steam-foam-forming surfactant effective for displacing the oil in a particular reservoir is selected by comparing the capabilities of foams formed by different surfactants for both flowing preferentially into permeable porous materials which contain that reservoir oil and displacing that oil from those materials.

6 Claims, 6 Drawing Figures

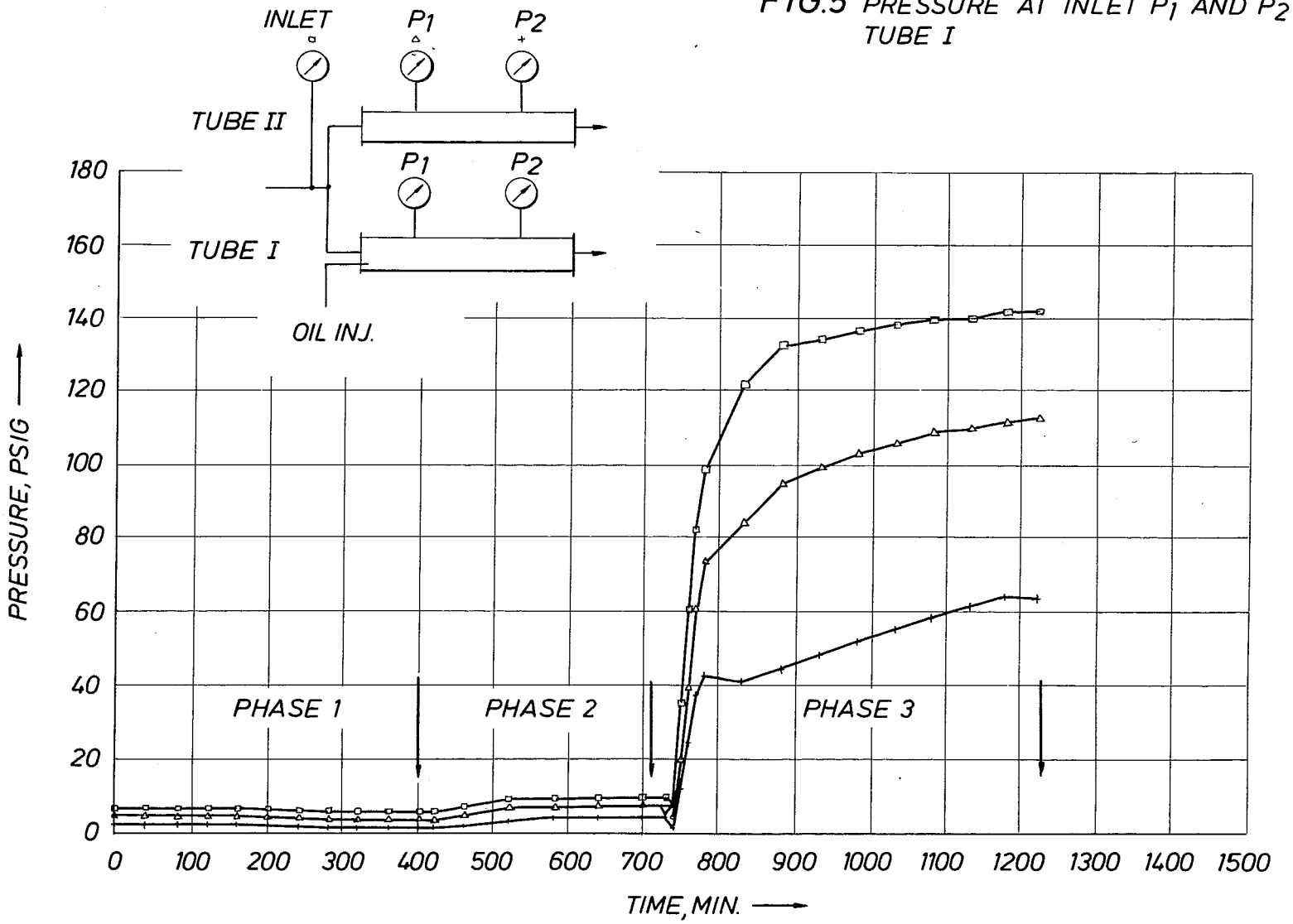
FIG.5 PRESSURE AT INLET $P_1$ AND $P_2$ TUBE I

FIG. 6 PRESSURE AT INLET P1 AND P2 TUBE II
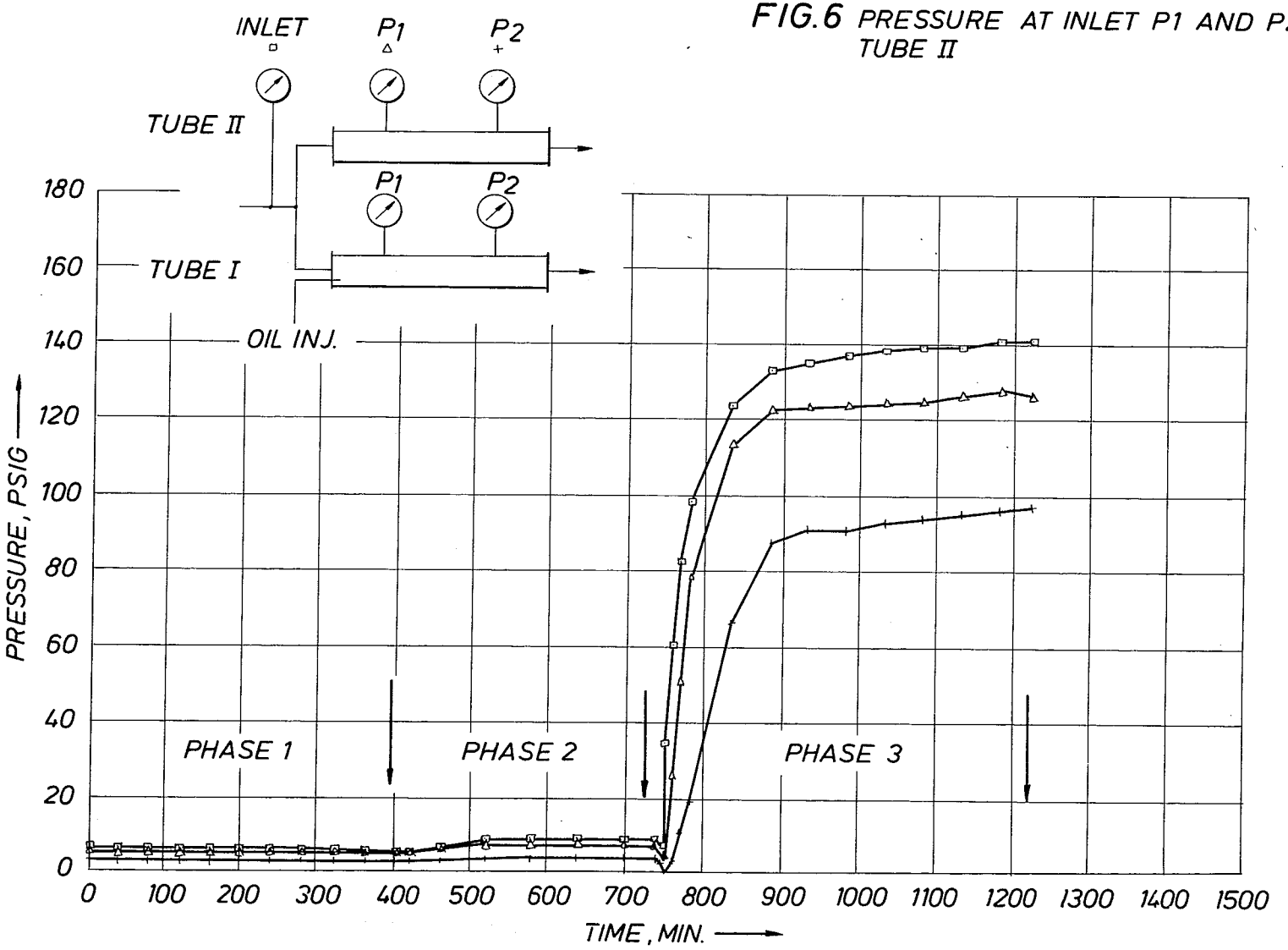

PROCESS FOR SELECTING A STEAM FOAM FORMING SURFACTANT

CROSS REFERENCE TO RELATED APPLICATION

The commonly assigned patent application Ser. No. 530,156, U.S. Pat. No. 4,532,993, filed Sept. 7, 1983, by R. E. Dilgren and P. B. Ritter discloses an improved steam foam soak oil recovery process in which a steam foam which is more mobile in oil-containing portions than in oil-free portions of the reservoir is injected so that the foam advances further along the oil-containing edges of a steam zone than it does along the oil-free middle portion of that zone. The disclosures of that application are incorporated herein by reference.

BACKGROUND OF THE INVENTION

The present invention relates to improving a process for displacing oil by injecting a steam foam into (or forming it within) an oil-containing subterranean reservoir. More particularly, the invention relates to improving such a process by selecting the most effective one of a plurality of surfactant materials for forming a steam foam which is effective in both flowing preferentially into oil-containing portions of the reservoir and displacing that oil within the reservoir.

It is known that foams or foam-like mixtures of gas and liquid are less mobile within a permeable porous material, such as an earth formation, than are either the gaseous or liquid components of such a foam. Prior oil-displacing uses of foams are described in patents such as the following: U.S. Pat. No. 4,086,964 by R. E. Dilgren, G. J. Hirasaki, H. J. Hill and D. G. Whitten describes injecting steam, surfactant, noncondensible gas and electrolyte for forming a steam foam which is significantly less mobile than steam. U.S. Pat. No. 4,393,937 by R. E. Dilgren and K. B. Owens describes an improvement of the U.S. Pat. No. 4,086,964 patent using an alpha-olefin surfactant which is capable of reducing the mobility of the injected fluid to a greater extent than that provided by the most effective surfactant described in the prior patent. In those patents, as well as the Ser. No. 530,156 patent application, the criteria by which the surfactant to be used was judged amounted to comparing the permeability to steam of a sand pack containing the reservoir oil at residual oil saturation with the permeability to the steam mixed with the surfactant material.

Other prior processes for selecting the surfactant to be used in forming a foam amount to comparisons based on measurements of the height of foam the surfactant can form within an open column, comparing such foam heights before and after heating the surfactant, measuring the pressure gradient developed by surfactant-containing mixtures flowing through permeable porous media, such as sand packs, and the like. U.S. Pat. No. 3,357,487 measures the heat stability of a surfactant by measuring the surface tension of an aqueous solution of it before and after heating at 650° F. for two hours. U.S. Pat. No. 4,148,217 compares the pressure drops during displacement of water with mixtures of water in the presence and absence of the surfactant to determining the foam forming strengths of surfactant which might be used in steam foam oil displacement processes. U.S. Pat. No. 4,458,759 suggests that, for improving the oil recovery from steam injected at about 365° to 500° F., almost any organic sulfonate surfactant is suitable as long as its decomposition rate at such temperatures shows "a leveling off trend after about 5–10 hours" (Col. 2, lines 59–64).

SUMMARY OF THE INVENTION

The present invention relates to improving a process for displacing oil within a subterranean reservoir by injecting steam and a foam-forming surfactant into the reservoir. The invention provides an improved procedure for determining which surfactant material is most effective for a particular reservoir. Steam of a type to be used in the oil producing process is mixed with each of a plurality of surfactant materials to form steam foams which are substantially the same except for the compositions of the surfactant materials. Each foam is injected into a pair of substantially equally permeable and equally available permeable porous materials while oil which is the reservoir oil or an equivalent oil is co-injected into one of the permeable materials. Measurements are made of both the proportion of foam which flows through each of the permeable materials and regarding the permeable material into which the oil is co-injected, the extent by which that oil is removed by the foam.

BRIEF DESCRIPTION OF THE DRAWINGS

FIGS. 5 and 6 are plots of pressures with time in the respective tubes I and II.

DESCRIPTION OF THE INVENTION

In view of the fact that in a situation such as a mature steam drive in a heavy oil reservoir with little or no dip, the steam has essentially only two places to go: (1) the desaturated steam layover region at the top of the reservoir, and (2) the lower portion of the reservoir where oil saturation is higher. The present process models such a situation. It provides competing paths of matched permeable porous materials, such as sand packs of Ottawa sand, mounted horizontally and connected in parallel with a common injection line for the injection of a steam or steam foam, with a provision made for a continuous injection of oil into one of the parallel paths.

In the testing of two surfactants by the present process it was found that although both were effective in reducing the mobility of the steam-containing fluid in the steam layover region and both increased the amount of steam which moved into or along the bypassed layer of oil, one of the two was more effective in mobilizing and producing the injected oil, as was reflected in a lower final oil saturation in the permeable porous material into which oil was injected. This occurred even though the foam formed by the other surfactant generated higher absolute pressure and a higher pressure gradient during its flow through the competing paths and thus indicates that, at least with some reservoir oils, there is a detergency aspect involved in a steam foam oil recovery process and the mobility control of the steam-containing fluid may not be the complete story.

In a preferred testing procedure four pairs of matched permeable materials (such as sandpacked tubes I and II) are utilized for conducting comparative tests or experiments regarding two surfactants. Duplicate tests, with each test using two of the matched permeable materials, are preferably conducted with each of the surfactants.

Figure 1:
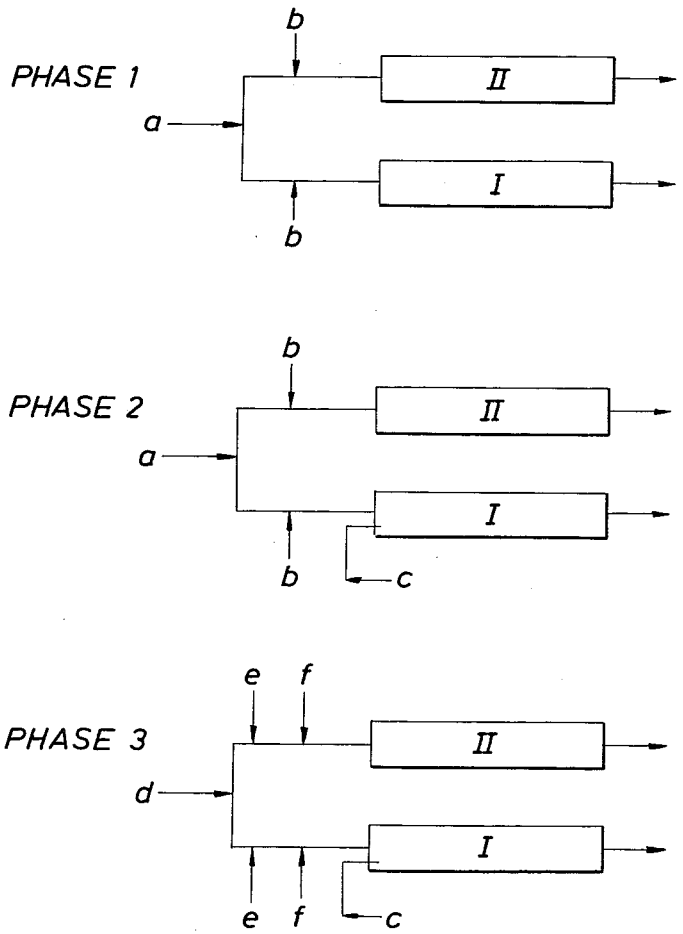
FIG. 1 is a schematic illustration of the apparatus and three test phases which are preferably employed in the present process.

FIG. 1 shows a particularly suitable form of apparatus and testing phases for use in the present invention. Tubes I and II are horizontal sand packs with porosities of about 33.2 to 34.1 percent, permeabilities of about 5.1 to 5.6 darcies, and pore volumes of about 122 to 126 milliliters. The flow lines a and d are common injection lines for injecting steam or steam and noncondensible gas. The lines b are for injecting liquid water. The lines c are for injecting oil into Tube I. The lines e and f are for injecting foam-forming components such as aqueous solutions of, respectively, surfactant and electrolyte.

The purpose of the phase 1 testing procedure is to ensure that within each pair of permeable porous materials, i.e., tubes I and II, an equal division of steam is made between each pair of the matched permeable materials when there is no injection of oil or foam. In an exemplified particularly preferred procedure, during phase 1, a constant rate such as 2.8 milliliters per minute of water is converted to 100% quality steam and is injected through line a while 1.4 milliliters per minute of liquid water are being injected through each of the lines b. It was found that by periodic measurements at times such as 200, 400 and 600 minutes after the start of the resultant injections of 50% quality steam, the proportions of water produced through tube I of each of four pairs of matched sand packs were substantially exactly 50%.

The purpose of phase 2 of the tests is to establish the effect of oil injection into tube I on the split (or proportioning) of steam between tubes I and II. In the exemplified procedure, oil from a reservoir to be treated was injected through inlet c at the rate of 0.6 grams per minute.

Figure 2:
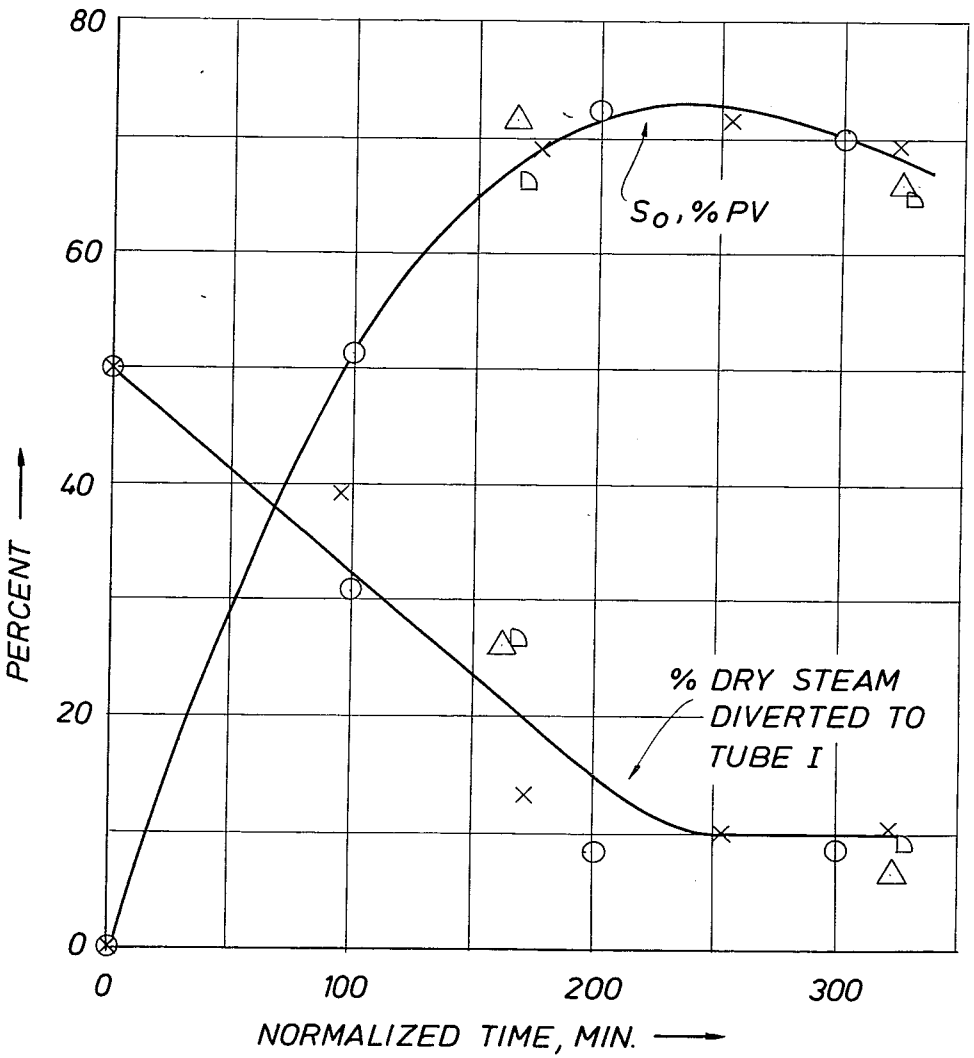
FIG. 2 shows a plot of oil saturation and proportion of steam diverted into tube I of FIG. 1 during phase 2 of the test.

FIG. 2 shows the buildup of oil saturation in tube I and the percent of the steam which became diverted into that tube, due to the relative permeability effects created by the injection of oil. When the oil saturation in tube I was about 70% the steam (which had been equally proportioned between tubes I and II during the phase 1 testing) was redistributed, with only 10% of the steam going into tube I and 90% going into the oil-free tube II (which simulates a desaturated steam layover zone on theif zone in an oil-containing reservoir).

In phase 3 of the testing, the injection of oil is continued at the same rate while the steam is being injected as a steam foam. In an exemplified particularly suitable procedure, the steam foam was formed by injecting nitrogen at a rate of 12 milliliters per minute, through line d, along with the dry steam, and injecting an aqueous solution of 1% by weight of surfactant at a rate of 0.7 milliliters per minute through each of the inlets e and also injecting an aqueous solution of 6% by weight of sodium chloride at a rate of 0.7 milliliters per minute through each of the inlets f (so that a steam foam is formed as the steam and steam-foam-forming components enter into the faces of the permeable porous media in tubes I and II).

Figure 3:
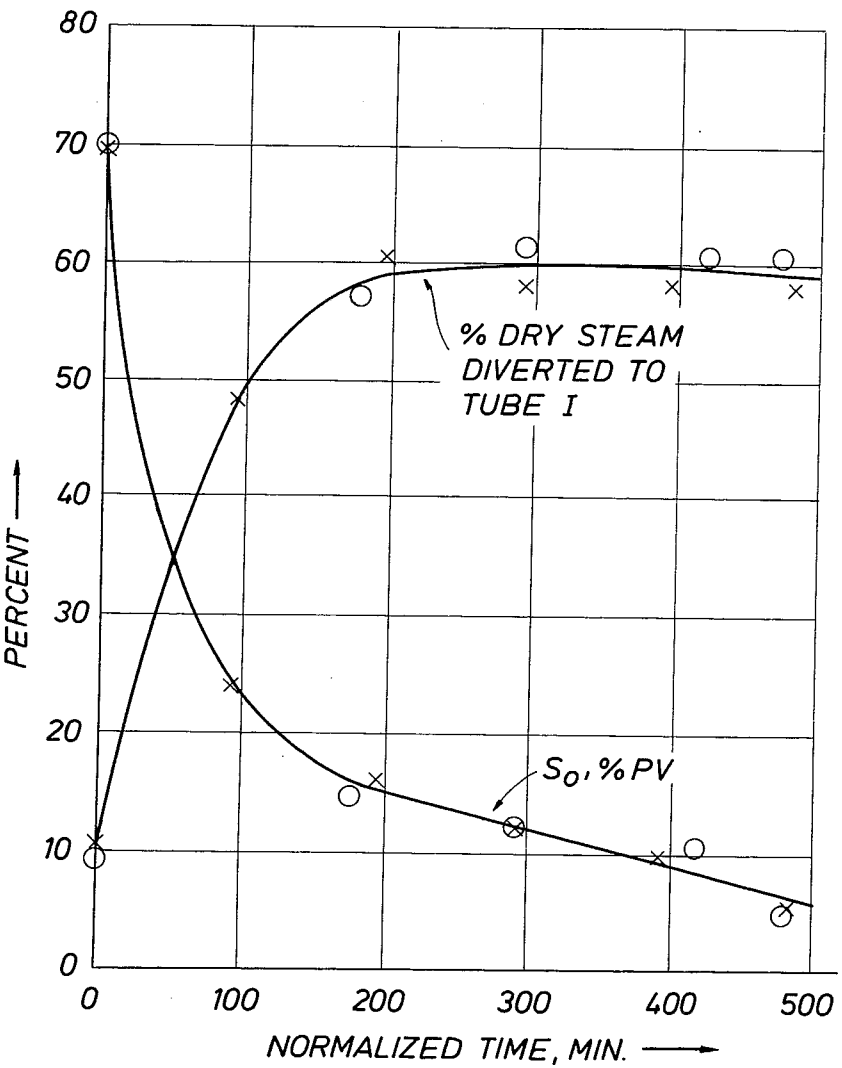
FIG. 3 is a similar plot of similar quantities during the third phase testing of a particular surfactant.

FIG. 3 shows the change of percent oil saturation and percent steam foam flow within tube I with time during a phase 3 testing (as exemplified above) of foam formed by surfactant A. Injecting this foam caused the oil saturation in tube I to be reduced from about 70% to about 5% pore volume while the percent of steam flowing through tube I increased from about 10 to 60%. The crosses and circles demark the respective data points obtained in duplicate tests, and are indicative of good reproducibility.

Figure 4:
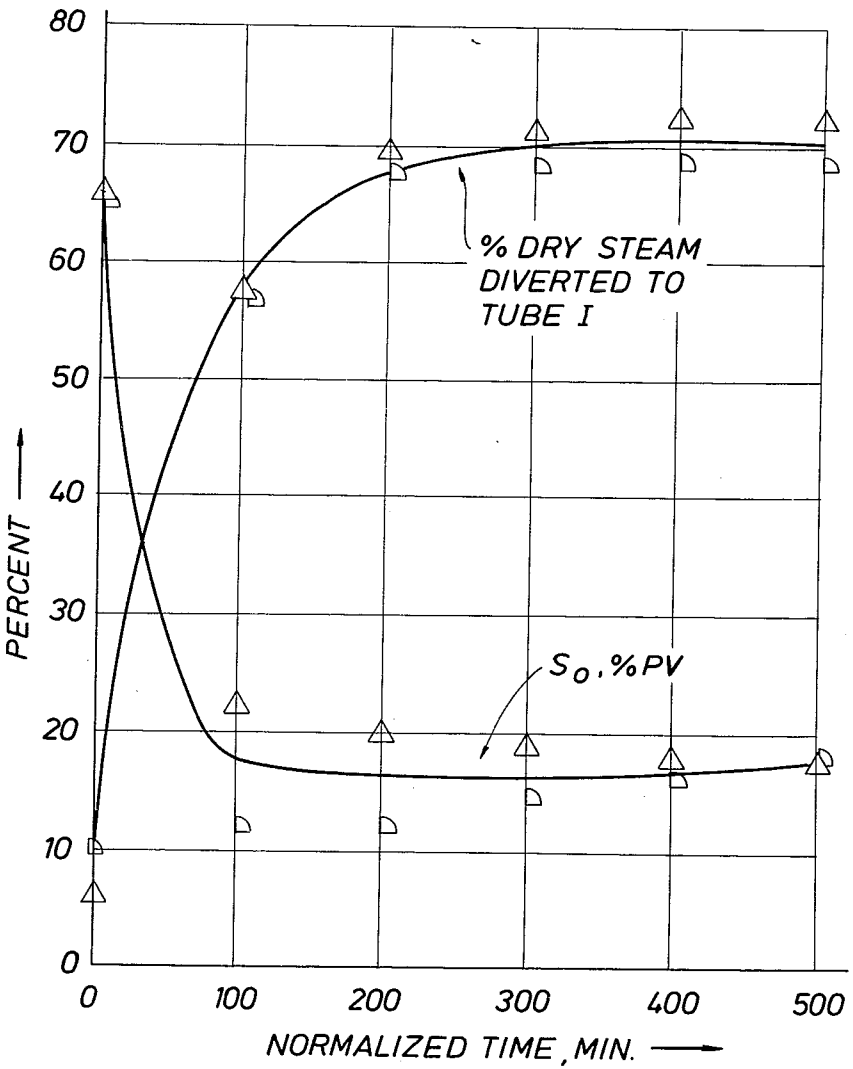
FIG. 4 is a plot like that of FIG. 3 regarding a different surfactant.

FIG. 4 shows a plot of similar data from duplicate experiments with the foam from a surfactant B. The final oil saturation provided by this foam was 17% pore volume (rather than the 5% left by the foam from surfactant A). With the foam provided by surfactant B, the transient oil saturations for the duplicate tests were not as close as those from the surfactant A case, but the final oil saturations were in good agreement.

The diversion of the majority of the steam foam into tube I during the phase 3 portion of the exemplified testing is mainly due to the debilitating effect of the crude oil on the foam strength. Since tube II contains no oil, the foam in tube II displays a greater resistance to flow, i.e., a lower mobility, and thus most of the steam foam seeks the less resistant path through tube I. The same effects are reflected in respect to higher pressure levels observable at interior pressure taps within such tubes.

FIGS. 5 and 6 show plots of the pressure variations with time during the testing of foams from surfactant A in, respectively, tubes I and II. The higher pressure levels exhibited along tube II relative to those along tube I is true even through the overall pressure gradient across tubes I and II (in any given test) are necessarily the same since there is a common connection line to both of the tubes and both are open to atmospheric pressure on the downstream end.

The fact that the steam foam from surfactant A led to a lower final oil saturation than did the foam from surfactant B although the foam from surfactant B generated a higher absolute pressure and higher pressure gradients indicates that, at least with respect to the reservoir oil being tested, a detergency aspect of the steam foam oil displacement process is important and mobility control may not be the complete story.

Table 1 summarizes data from the exemplified experiments with surfactants A and B. It indicates that the higher pressure gradient and greater steam diversion to tube I exhibited by surfactant B did not result in a lower residual oil saturation in that tube.

TABLE 1

| Surfactant | Run | Pressure Gradient PSI/Ft | Steam Diverted to Tube I % | Final Oil Saturation % |
|---|---|---|---|---|
| Surfactant A | 1 | 155 | 57 | 5.1 |
| | 2 | 159 | 61 | 4.6 |
| Surfactant B | 3 | 170 | 72 | 16.9 |
| | 4 | 175 | 67 | 17.6 |

The temperatures with time within the tubes I and II were measured near the locations at which the pressures were measured (indicated on FIGS. 5 and 6). With respect to the exemplified testing of the foams from surfactants A and B, although the temperatures observed measured, the temperatures in tube II were less than saturated steam temperatures for the pressures measured. For example, the temperatures observed in tube II during the testing of the foam from surfactant B were as much as 20°–30° below saturated steam temperature. Such a temperature behavior appears to suggest that a hot water noncondensible gas foam existed in the tube II model of the desaturated steam zone within the reservoir; hot water noncondensible gas foams have generally exhibited lower mobilities than corresponding steam foams.

In general, the present invention is applicable to substantially any foam-forming surfactant which might be available for use at a particular reservoir site. Examples of preferred surfactants include anionic surfactants such as those described in U.S. Pat. No. 4,086,964 of which individual surfactants or mixtures of surfactants having foam-forming and adsorptivity properties at least substantially equivalent to those of sodium dodecylbenzene sulfonate are particularly preferred and also include olefin sulfonate surfactants such as those described in U.S. Pat. No. 4,393,937 of which the olefin sulfonates such as those derived from olefins in the C-16 to C-18 range, such as Siponate A-168 available from Alcolac Incorporated or Stepanflo-30 available from Stepan Chemical Company.

The present invention is applicable to substantially any subterranean oil to be produced and/or displaced away from a well, during a drive or soak type of process, by means of a displacement with a steam foam or any oil-displacing fluid which contains steam and surfactant. The present tests can be performed by obtaining samples of the reservoir oil or an oil which is substantially equivalent to the reservoir oil with respect to viscosity and steam foam debilitating characteristics. The testing is preferably conducted to select at least one of at least two surfactant materials available for use in a particular reservoir. Where a given surfactant material has previously been tested with an appropriate oil, the data from its behavior in a prior test can be utilized in comparison with test data obtained by similarly testing a different surfactant material.

The surfactant material selected for use in a given oil recovery situation is preferably one which exhibits oil diverting tendencies at least suitable with respect to the steam channeling tendencies of the reservoir while at the same time exhibiting detergency aspects which are at least substantially as effective as or better than those of other surfactant materials which are at least about equally available at the reservoir site.

The apparatus used and the analyses used in the practice of the present invention can suitably be those conventionally available. It is important that for a given type of matched pairs of permeable porous materials, such as the sand packs of tubes I and II, that tests be conducted which are at least substantially equivalent to those of the present phase 1 tests to ensure an equal distribution of the steam in both paths of a given pair of permeable materials. Transient pressure measurements indicative of the steam foam or steam-foam-forming capabilities in each of the pairs of competing paths as well as such measurements of temperatures, are preferably made perodically with time during the tests. However, where detailed comparisons between the surfactant materials are not essential, the measurements can be restricted to monitoring the relative proportioning of the steam foam and measuring the residual oil saturation obtained within the permeable porous medium into which the oil is injected.

What is claimed is:

1. In a process in which oil is displaced within a subterranean reservoir by injecting steam and surfactant-containing steam-foam-forming components to form a steam-containing fluid having less mobility than steam alone and thus having a greater tendency to avoid bypassing oil, an improved procedure for selecting which of a plurality of surfactant materials is the most effective for both avoiding oil bypassing and efficiently displacing the oil contained within a particular reservoir, comprising:

mixing steam with each of a plurality of surfactant materials to form a plurality of steam foams which are substantially equivalent except for the compositions of the surfactant materials;

displacing each of said foams into and through a pair of substantially equally available and equally permeable porous materials while concurrntly displacing an oil which is or is substantially equivalent to the reservoir oil through one of the permeable porous materials and measuring both the proportion of each of said foams which flows through the respective oil-free and oil-containing permeable material and the extent to which the foam removes the oil from the oil-containing material, in order to compare the capabilities of each of the surfactant materials with respect to both the mobility controlling and oil removing aspects when the foams formed by them have equal opportunities to flow through either a path which is oil-free or one which is oil-containing.

2. The process of claim 1 in which said tested steam foams comprise mixtures of steam of the quality to be injected into the reservoir oil mixed with kinds and amounts of noncondensible gas and/or electrolytes to be mixed with the steam injected into the reservoir.

3. The process of claim 1 in which measurements are made periodically of transient proportions of total amounts of said foams flowing in each of said permeable materials.

4. The process of claim 1 in which measurements are made periodically of transient pressures of said foams in said permeable materials.

5. The process of claim 1 in which measurements are made periodically of transient temperatures of said foams in said permeable materials.

6. A method for formulating a steam-foam-forming mixture of steam and surfactant-containing steam-foam-forming components to be injected into an oil-containing subterreanean reservoir, comprising:

arranging a pair of fluid conduits for conducting parallel flows of fluid through actual or simulated earth formations of substantially the same composition and permeability;

flowing steam through the conduits and, to the extent required, adjusting the system to provide flow rates which are at least substantially equal within each of the two paths available to the steam;

while flowing steam so that it can enter into both conduits at substantially the same rate, flowing the oil being treated into one conduit at a rate such that the oil contacts at least most of the steam that flows through that oil-containing conduit;

while flowing the oil into the oil-containing conduit at the same rate, separately testing different mixtures by flowing them so that they can enter into both conduits at substantially the same rate and in the same way that the steam was inflowed into those conduits, using mixtures of the same quality and temperature of steam with each of at least two surfactant-containing steam-foam-forming components;

determining the relative proportions of the total amounts of the steam-containing mixtures which flow through the respective oil-containing and oil-free conduits and the extent to which those steam-containing mixtures displace the oil from the oil-containing conduit; and formulating as said mixture to be injected into a subterranean reservoir a mixture of steam and steam-forming surfactant components which are effective for both causing a flow of steam-containing fluids into permeable materials containing the reservoir oil and for displacing that oil from those materials.

* * * * *